US007922040B2

(12) United States Patent
Pierson

(10) Patent No.: US 7,922,040 B2
(45) Date of Patent: Apr. 12, 2011

(54) APPARATUS AND METHOD FOR CLEARING A CAULKING GUN

(76) Inventor: Hank E. Pierson, Eureka, CA (US)

( * ) Notice: Subject to any disclaimer, the term of this patent is extended or adjusted under 35 U.S.C. 154(b) by 251 days.

(21) Appl. No.: 12/148,292

(22) Filed: Apr. 16, 2008

(65) Prior Publication Data

US 2009/0064432 A1 Mar. 12, 2009

Related U.S. Application Data

(60) Provisional application No. 60/967,806, filed on Sep. 6, 2007.

(51) Int. Cl.
*B67D 1/07* (2006.01)

(52) U.S. Cl. ..... 222/151; 222/148; 222/191

(58) Field of Classification Search ..... 222/151, 222/148, 149, 191, 192, 563
See application file for complete search history.

(56) References Cited

U.S. PATENT DOCUMENTS

| | | | | |
|---|---|---|---|---|
| 4,019,654 | A * | 4/1977 | van Manen | 222/1 |
| 6,375,051 | B1 * | 4/2002 | Iverson | 222/552 |
| 6,516,972 | B1 * | 2/2003 | Knestout | 222/151 |
| 6,599,293 | B2 * | 7/2003 | Tague et al. | 606/94 |
| 6,691,900 | B1 * | 2/2004 | Cermak, III | 222/552 |

* cited by examiner

*Primary Examiner* — Michael Barr
*Assistant Examiner* — Saeed T Chaudhry
(74) *Attorney, Agent, or Firm* — Kolisch Hartwell, P.C.

(57) ABSTRACT

A device and method of clearing non-fluid caulk from a caulk dispensing tube includes drilling a bit member through a thread cleaning device and into the solid caulk blocking the dispensing tube; then removing the bit member from the dispensing tube and reversing the rotational direction of the bit member, allowing the thread cleaning device to clear caulk off of the bit member after it has been removed from the dispensing tube.

9 Claims, 3 Drawing Sheets

APPARATUS AND METHOD FOR CLEARING A CAULKING GUN

CROSS-REFERENCE TO PRIORITY APPLICATION

This application is based upon and claims the benefit under 35 U.S.C. §119(e) of U.S. Provisional Patent Application Ser. No. 60/967,806, filed Sep. 6, 2007 and is incorporated herein by reference in its entirety for all purposes.

BACKGROUND

Caulk is used for many purposes as a sealant to fill cracks, seams or holes in buildings, boats, vehicles, etc. Caulk is typically supplied in containers equipped with dispensing tubes. A delivery device is used to diminish the volume inside the tube, causing semi-fluid caulk to move through the dispensing tube, out the dispensing aperture, to the desired location. Once the caulk is exposed to air outside the tube, it cures and hardens to a non-fluid state.

Sometimes a person uses the entire contents of a caulking container in one project. However, often a person uses only a fraction of the caulk inside the container, hoping to save the leftover caulk for future use. A significant problem with using a single caulking tube for multiple projects performed at different times, is that caulk inside the dispensing tube tends to harden between projects, thus blocking fluid caulk from exiting the container for use in subsequent projects.

DETAILED DESCRIPTION

Preferred embodiments are shown in FIGS. 1-7. However, it will be apparent that many variations of the illustrated devices, as covered by the claims below, may be used in similar manners to accomplish the same basic functions.

Figure 1:
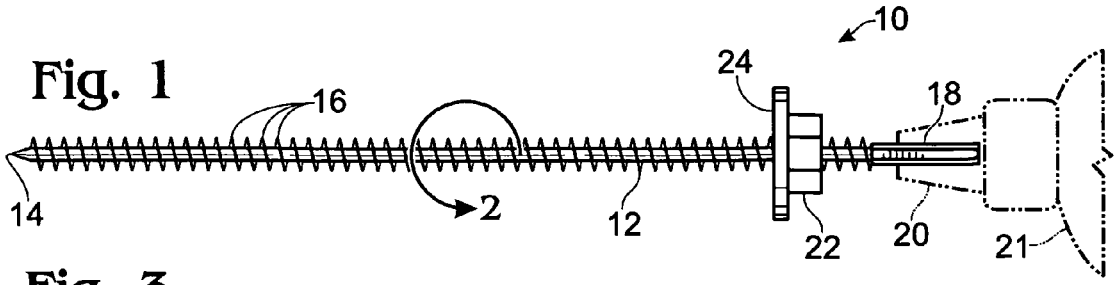
FIG. 1 is a side view of a device for clearing a caulk dispensing tube.

FIG. 1 shows caulk clearing apparatus 10. Lag bolt or bit member 12 has pointed tip 14 at one end and helical threads 16 extending over a substantial length of bit member 12. At the other end of bit member 12, shank 18 is provided for engaging chuck 20 of drill 21. Nut portion 22 has internal threads (not shown) complementing threads 16 of bit member 12. Plate or shield portion 24 is connected to nut portion 22 for blocking or shielding caulk waste, as explained in more detailed below.

Figure 2:
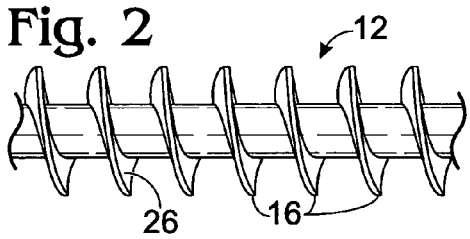
FIG. 2 is a partial close-up view of the device shown in FIG. 1.

FIG. 2 shows a close-up view of bit member 12. Threads 16 have cupped faces 26 which assist with caulk removal in the clearing procedure described below.

Figure 3:
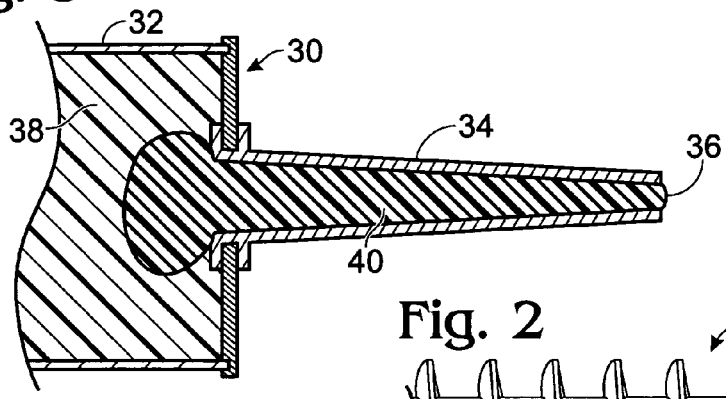
FIG. 3 is a partial cross-sectional view of a caulk container and dispensing tube with hardened caulk blocking the tube.

FIG. 3 shows caulk dispenser 30 including container 32 and dispensing tube 34. Distal end of dispensing tube 34 has aperture 36 for directing fluid caulk out of dispenser 30. FIG. 3 shows a portion of caulk dispenser 30 between caulking projects in which there is still usable fluid caulk 38 inside container 32. However, cured non-fluid caulk 40 blocks fluid caulk 38 from exiting dispensing tube 34 through aperture 36.

Figure 4:
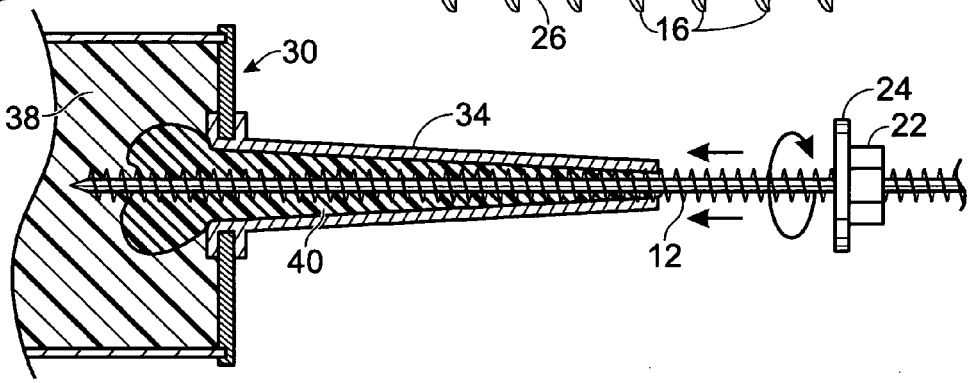
FIG. 4 is a partial cross-sectional view of the container and dispensing tube shown in FIG. 3 with a caulk clearing device penetrating cured caulk inside the dispensing tube.

In FIG. 4, bit member 12 has been rotated in a clockwise direction causing bit member 12 to penetrate through non-fluid caulk plug 40 in dispensing tube 34. Dispenser 30 includes a chamber or container 32 for containing fluid caulk 38. Chamber 32 has an exit port to which tapered dispenser tube 34 is attached. Dispensing tube 34 has distal dispensing aperture 36 for dispensing fluid caulk. As shown in FIG. 4, bit member 12 is inserted through dispensing tube 34, with the pointed tip being directed away from dispensing aperture 36. The cupped orientation of threads 16 are directed toward dispensing aperture 36.

Figure 5:
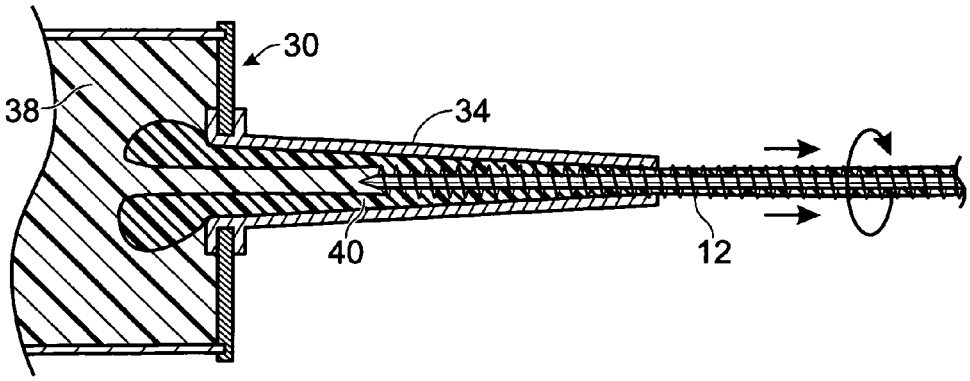
FIG. 5 is a partial cross-sectional view of the caulk container and clearing device shown in FIG. 4 with the clearing device partially removed from the dispensing tube.

FIG. 5 shows bit member 12 being pulled out of dispensing tube 34 along with non-fluid caulk plug 40. It may sometimes be preferable to stop rotation of bit 12 while pulling bit 12 out of dispensing tube 34. Alternatively, it may be possible to remove bit 12 from dispensing tube 34 while continuing to rotate bit 12 in a clockwise direction. Devices similar to those used on cork removers may also be employed to exert a pulling force on bit 12 and non-fluid caulk 40. An example of such a device is shown in FIGS. 6 and 7, and described in detail below.

Figure 6:
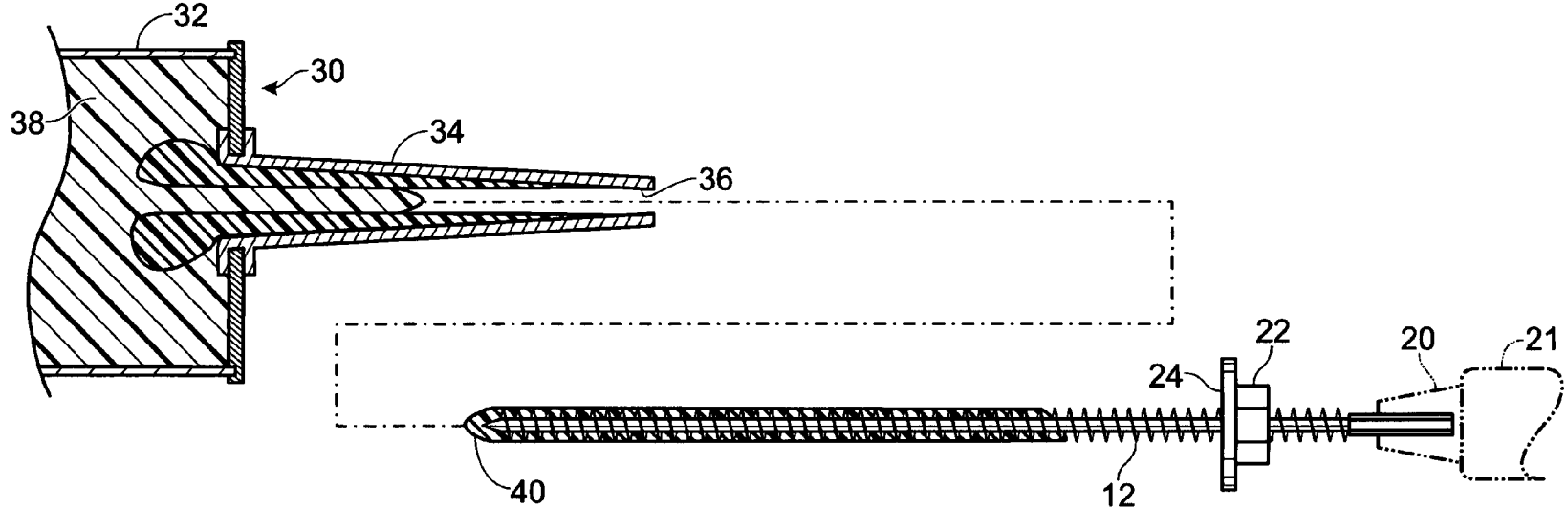
FIG. 6 is a partial cross-sectional view of a caulk container and clearing device after removing the clearing device with cured caulk from the dispensing tube.

FIG. 6 shows bit or bit 12 removed from caulk dispenser 32 leaving aperture 36 opened for dispensing fluid caulk 38.

Figure 7:
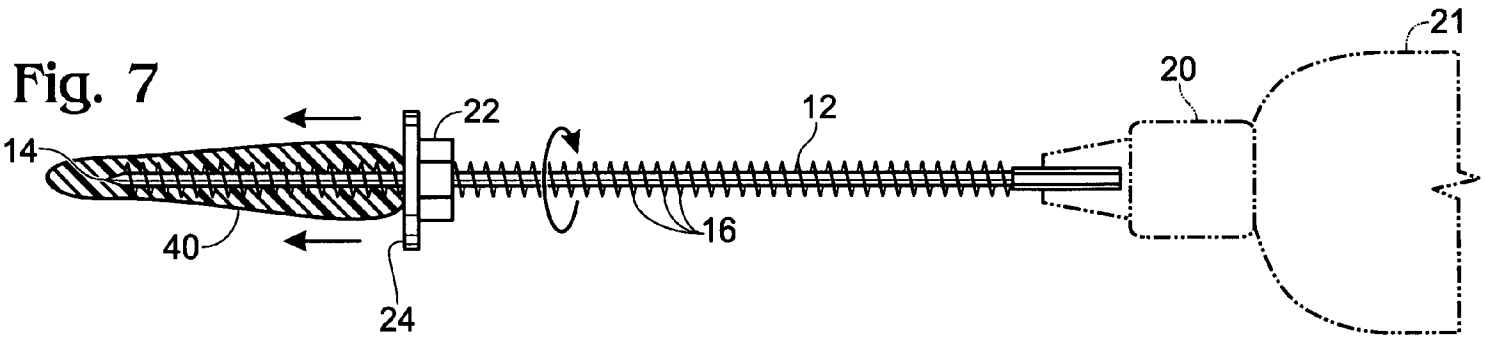
FIG. 7 is a side view of the caulk clearing device in the process of removing caulk from the threaded bit member.

In FIG. 7, bit 12 is driven by drill 21 in a counterclockwise direction while nut 22 is prevented from rotating. This causes nut 22 to move toward distal tip 14 of bit 12 along with caulk plug 40. In the process of removing bit 12 from nut 22, threads 16 are cleaned so that caulk clearing apparatus 10 is ready for use again prior to a subsequent caulking project.

Figure 9:
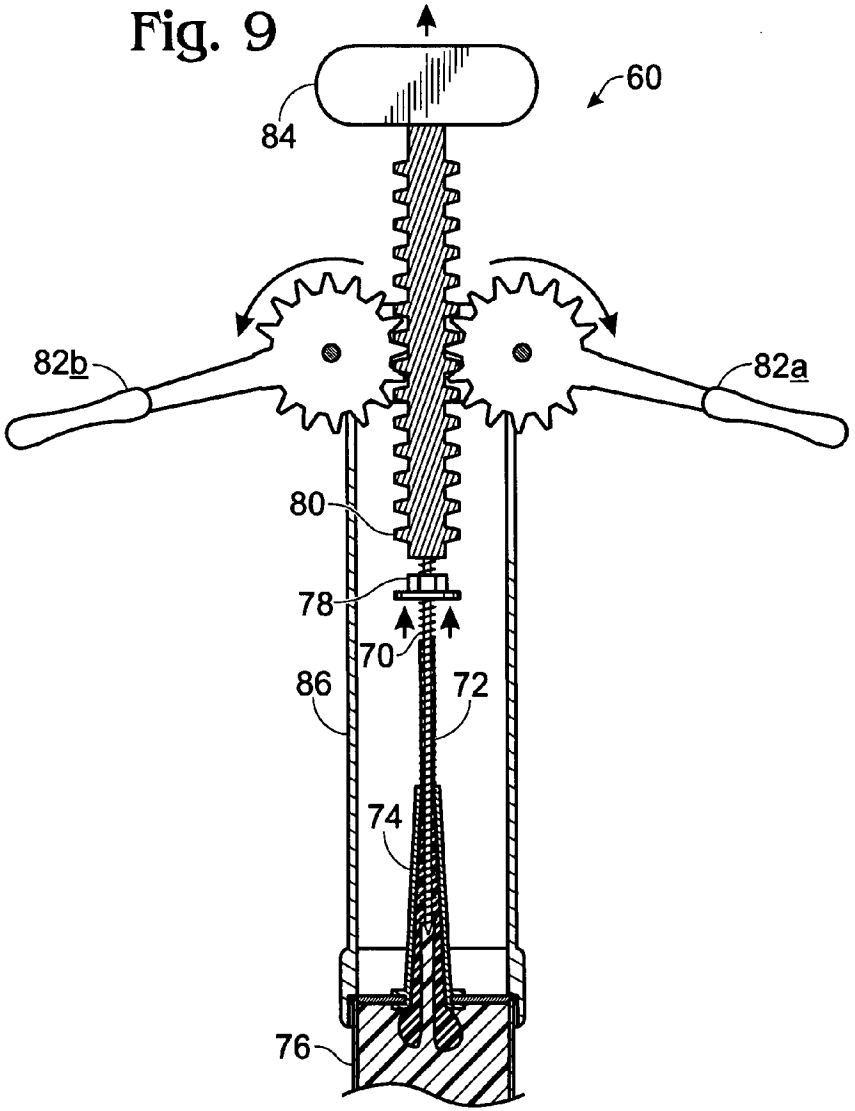
FIG. 9 is another cross-sectional view of the device shown in FIG. 8 with the bit member and non-fluid caulk portion partially extracted from the dispensing tube of the caulk container.
Figure 8:
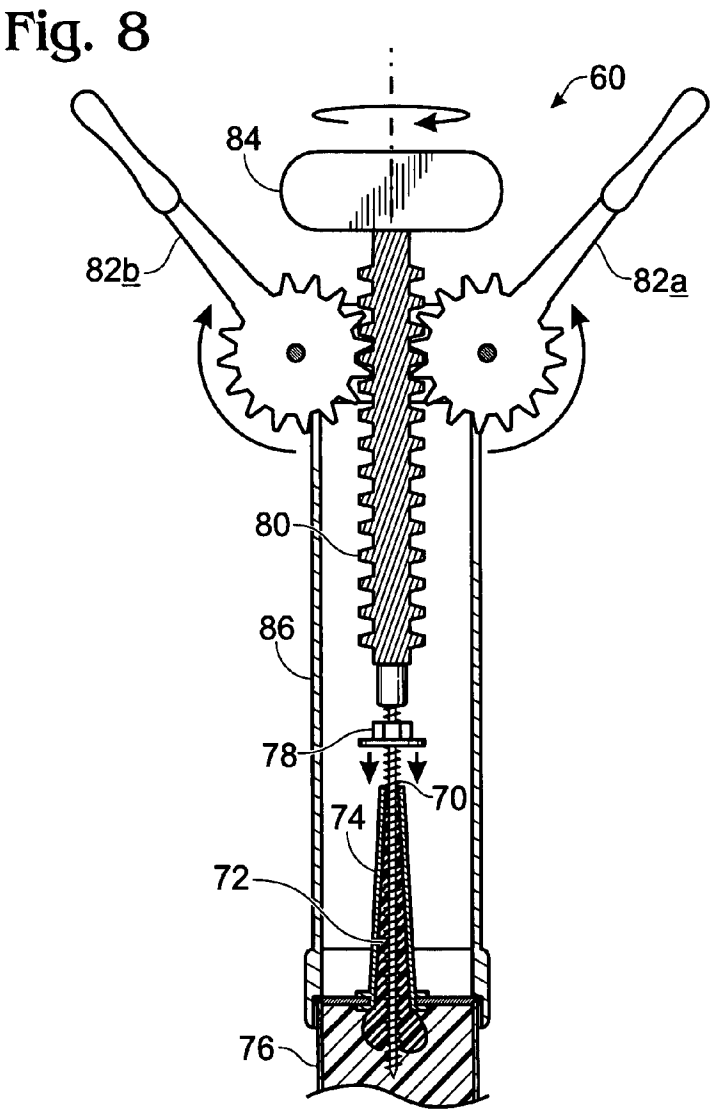
FIG. 8 is a cross-sectional view of a manual device being used to extract non-fluid caulk from the dispensing tube of a caulk container.

FIGS. 8 and 9 show another embodiment of the invention. Caulk extracting device 60 has threaded bit member 70 which is employed similarly to the bit member previously described and illustrated. Threaded bit member 70 penetrates non-fluid caulk portion 72 which is blocking the dispensing tube 74 of caulk container 76. Nut member 78 engages the threads on bit member 70 and is used at the end of the process to clear caulk from the threads of bit member 70, as already described. Bit member 70 is connected to a second threaded portion 80 which engages gear portions connected respectively to handles or levers 82*a* and 82*b*. Second threaded portion 80 is rigidly connected to handle 84 which allows a user to manually rotate bit member 70 in clockwise or counterclockwise directions. Bracing structure 86 engages outer housing of caulk container 76. Alternatively, a bracing structure may engage dispensing tube 74 providing a fixed surface to pull against as levers 82*a* and 82*b* are manipulated as shown in FIG. 9 causing extraction of non-fluid caulk portion 72 from dispensing tube 74 of caulk container 76.

In one example of a caulk clearing device, the bit member is made of metal and is approximately 10 inches long. The shank portion for engaging the chuck on a drill is approximately 1.25 inches. The diameter of the threaded portion at the edge of the threads is approximately ⅜ inch. The diameter of the shaft inside the threads is as small as possible while providing sufficient strength to not break during use. The caulk remover nut is made of metal and is round and approximately 1.5 inches in diameter. The side of the nut facing the caulk dispensing tube is smooth for easy cleaning.

A nut member may take various forms, provided that it has a hole with internal helical threads corresponding to the threads on the bit, bit, or shaft. For example, the nut member may initially take the form of a solid block made of a material that may be easily drilled through by the bit. The block may be made of plastic, wax, wood, etc. Prior to drilling into the dried caulk inside the plugged dispensing tube, the bit is drilled through the block, creating corresponding threads inside the block which function to clean the threads on the bit when it is reversed out of the hole.

A method of clearing solid caulk from a dispensing tube may be carried out by first providing a bit member having first (distal) and second (proximal) ends, the first end of the bit member having a pointed tip, the second end of the bit member having a shank for engaging a power tool. A threaded portion between the first and second ends of the bit member has helical threads for drilling into a non-fluid, relatively solid material. A thread cleaning device includes a body having a hole dimensioned to receive the bit member. The hole has internal threads corresponding to the threads on the threaded portion of the bit member, The shank of the bit member is then secured in the chuck of a power drill.

Next the power drill is operated to rotate the bit member in a clock wise direction causing the bit member to drill through non-fluid caulk blocking the dispensing channel of the dispensing tube of a caulk container, until the tip of the bit member reaches fluid caulk in the caulk container, The bit member is then pulled out of the dispensing tube along with the non-fluid caulk, thereby reconditioning the dispensing channel of the caulk container for subsequent use. Finally, the bit member is substantially cleaned by reversing the rotational direction of the bit member in a counter-clockwise direction, causing the thread cleaning device to substantially clear caulk from between the threads while moving the thread cleaning device towards the tip of the bit member.

Other methods or devices may be used for rotating the bit member. For example, the bit member may be rotated manually instead of using a power drill. The proximal end of the bit member may be configured to engage a handle or manual drill device. The drill or manual device may be equipped with a switch for reversing the rotational direction of the bit member.

The nut member is preferably big enough to handle easily. The nut member may be asymmetrical providing a handle portion for the user to grip while the bit member rotates. The plate or shield portion of the nut member is large enough to prevent or block overflow of waste caulk onto the main body of the nut member. The shield may be disposable or be lined with a disposable materials, for example, made of paper or plastic. The disposable liner may then be thrown away eliminating the need to clean the shield or bit member.

The bit member should have a cylindrical center portion. The threads generally flare outward from the center portion. A single helical thread may be used winding along the length of the bit member. The center portion of the bit member has a central axis. The thread may have a cross section in a plane containing the central axis which is symmetrical relative to a second plane which is perpendicular to the central axis. Alternatively, the cross section of the thread may be nonsymmetrical providing a cupping shape toward the proximal end of the bit member. The edge of the thread may also be sharpened to a degree providing a releasing or cutting advantage as the bit member is removed from the dispensing tube.

While embodiments of caulk clearing devices and method of clearing non-fluid caulk from a dispensing tube have been described and illustrated, many variations have been enabled by this disclosure. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application.

I claim:

1. A device for clearing a caulk dispensing tube comprising a caulk dispenser including a chamber containing fluid caulk, the chamber haying an exit port and a dispensing tube connected to the exit port and a dispensing tube connected to the exit port, the dispensing tube haying a distal aperture for dispensing fluid caulk, the dispensing tube haying a diminishing diameter from the exist port to the dispensing aperture, a bit member having first and second ends, the first end of the bit member having a pointed tip, the second end of the bit member having a shank for engaging a tool for rotating the bit member, a threaded portion between the first and second ends of the bit member, the threaded portion having a helical thread structure with a cupped orientation toward the second end of the bit member, a thread cleaning device including a body having a receiving side, an exit side, and a hole dimensioned to receive the bit member, the hole having internal threads corresponding to the thread structure on the threaded portion of the bit member, an enlarged shield portion on the exit side of the body for blocking caulk as the bit member is removed from the thread cleaning device, wherein the first end of the bit member is inserted in the dispensing tube, the pointed tip being directed away from the dispensing aperture, and the cupped orientation of the thread structure being directed toward the dispensing aperture.

2. The device of claim 1, wherein the tool includes a motor for powering rotation of the bit member.

3. The device of claim 1, wherein the tool is configured for manual operation to rotate the bit member.

4. The device of claim 1, further comprising a lever assembly configured to pull the bit member out of the dispensing tube.

5. A device for clearing a caulk dispensing tube comprising a bit member having first and second ends, the first end of the bit member having a pointed tip, a threaded portion between the first and second ends of the bit member, the threaded portion having a helical thread structure, a thread cleaning device including a body having a receiving side, an exit side, and a hole dimensioned to receive the bit member, the hole having internal threads corresponding to the thread structure on the threaded portion of the bit member, a shield portion on the exit side of the body for blocking caulk as the bit member is removed from the thread cleaning device, and a lever assembly configured to pull the bit member out of the dispensing tube.

6. The device of claim 5, wherein the helical thread structure has a cupped orientation toward the second end of the bit member.

7. The device of claim 5, wherein the second end of the bit member has a shank for engaging a power tool for driving rotation of the bit member.

8. The device of claim 5, wherein the second end of the bit member is connected to a handle for manually rotating the bit member.

9. The device of claim 5, wherein the bit member has a cylindrical core portion and a helical thread structure flaring out from the core portion, the thread structure having an effective diameter approximating a standard diameter of dispensing holes on caulk container dispensing tubes.

* * * * *